US012263515B2

(12) United States Patent
Ageba

(10) Patent No.: US 12,263,515 B2
(45) Date of Patent: Apr. 1, 2025

(54) PRESS FORMING TOOL AND PRESS FORMING METHOD

(71) Applicant: JFE STEEL CORPORATION, Tokyo (JP)

(72) Inventor: Ryo Ageba, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 220 days.

(21) Appl. No.: 17/927,300

(22) PCT Filed: Mar. 8, 2021

(86) PCT No.: PCT/JP2021/008870
§ 371 (c)(1),
(2) Date: Nov. 22, 2022

(87) PCT Pub. No.: WO2021/240942
PCT Pub. Date: Dec. 2, 2021

(65) Prior Publication Data

US 2023/0201903 A1 Jun. 29, 2023

(30) Foreign Application Priority Data

May 23, 2020 (JP) ..... 2020-090157

(51) Int. Cl.
*B21D 22/26* (2006.01)
*B21D 19/08* (2006.01)
(Continued)

(52) U.S. Cl.
CPC ..... *B21D 22/26* (2013.01); *B21D 37/10* (2013.01); *B21D 53/88* (2013.01)

(58) Field of Classification Search
CPC ..... B21D 22/26; B21D 22/24; B21D 22/06; B21D 37/10; B21D 53/88; B21D 19/08; B21D 24/005
See application file for complete search history.

(56) References Cited

U.S. PATENT DOCUMENTS 4,756,466 A 7/1988 Peck
5,211,047 A * 5/1993 Kaneyuki ..... B21D 53/88 72/347
(Continued)

FOREIGN PATENT DOCUMENTS

EP 3 305 429 A1 4/2018
EP 3 476 500 A1 5/2019
(Continued)

OTHER PUBLICATIONS

Sep. 13, 2023 Extended Search Report issued in European Patent Application No. 21813956.6.
(Continued)

*Primary Examiner* — Mohammed S. Alawadi
(74) *Attorney, Agent, or Firm* — Oliff PLC

(57) ABSTRACT

A press forming tool is configured to form a press forming part including: a top portion; a side wall portion having a recessed portion in which a bottom edge is recessed toward the top portion; and a flange portion formed outward on a bottom edge of the side wall portion, the recessed portion including a first curved portion continuous with the bottom edge being a portion having a large wall depth, an inclined side portion continuous with the first curved portion, a second curved portion continuous with the inclined side portion, and a recessed side portion having a small wall depth, arranged in order from the bottom edge being a portion having a large wall depth, the flange portion being formed such that the flange portion formed in the first curved portion becomes a shrink flange while the flange portion formed in the second curved portion becomes a stretch flange.

2 Claims, 14 Drawing Sheets

(51) Int. Cl.

| | |
|---|---|
| ***B21D 22/06*** | (2006.01) |
| ***B21D 22/24*** | (2006.01) |
| ***B21D 24/00*** | (2006.01) |
| ***B21D 37/10*** | (2006.01) |
| ***B21D 53/88*** | (2006.01) |

(56) References Cited

U.S. PATENT DOCUMENTS

| | | | | |
|---|---|---|---|---|
| 10,596,611 | B2 | 3/2020 | Nishimura et al. | |
| 2015/0273563 | A1 | 10/2015 | Miyagi et al. | |
| 2016/0121384 | A1 | 5/2016 | Sumikawa et al. | |
| 2016/0199897 | A1 | 7/2016 | Otsuka et al. | |
| 2016/0325330 | A1 | 11/2016 | Nitta et al. | |
| 2018/0133778 | A1 | 5/2018 | Tanaka et al. | |
| 2019/0030583 | A1* | 1/2019 | Nishimura ..... | B21D 24/005 |
| 2019/0111463 | A1 | 4/2019 | Natori et al. | |
| 2021/0220896 | A1 | 7/2021 | Shirakami et al. | |
| 2023/0191469 | A1 | 6/2023 | Ageba | |

FOREIGN PATENT DOCUMENTS

| | | | |
|---|---|---|---|
| JP | 2007-253173 | A | 10/2007 |
| JP | 2010-69490 | A | 4/2010 |
| JP | 6032374 | B2 | 11/2016 |
| JP | 2019-171440 | A | 10/2019 |
| WO | 2016/185105 | A1 | 11/2016 |
| WO | 2016/194963 | A1 | 12/2016 |
| WO | 2017/170533 | A1 | 10/2017 |

OTHER PUBLICATIONS

Sep. 12, 2023 Extended Search Report issued in European Patent Application No. 21813399.9.

Apr. 27, 2021 International Search Report issued in International Patent Application No. PCT/JP2021/008870.

* cited by examiner (a) TOP VIEW (b) SIDE VIEW

PRESS FORMING TOOL AND PRESS FORMING METHOD

FIELD

The present invention relates to a press forming tool (tools of press forming) and a press forming method applicable to press forming of a member such as an automotive part from a metal sheet, and particularly relates to a press forming tool and a press forming method applicable to press forming parts having a top portion, a side wall portion having a portion in which a wall height changes in a side view, and a flange portion formed on a bottom edge which is a side portion of the side wall portion provided on an opposite side of the top portion.

BACKGROUND

In recent years, in order to achieve weight reduction of automotive body due to environmental problems, high-strength steel sheets have been frequently used for automotive parts. However, a high-strength steel sheet is poor in elongation as compared with a steel sheet having low strength and thus tends to cause fracture during material processing. In addition, even when a high-strength steel sheet is used, sheet metal thinning is also performed at the same time for further weight reduction, leading to a problem of high likelihood of occurrence of buckling of the steel sheet and occurrence of wrinkles during press forming. Therefore, development of a press forming method for suppressing fracture and wrinkles is strongly required.

For example, Patent Literature 1 discloses a press forming method that uses a wrinkle suppression pad (blank holder) driven separately from a punch and a die and makes it possible to manufacture an automotive part which is likely to cause wrinkles and stretch flange fractures inside a product with no forming defectiveness. The method disclosed in Patent Literature 1 is considered to be able to manufacture an automotive part that is likely to cause wrinkles and fractures inside a product without forming defectiveness.

CITATION LIST

Patent Literature

Patent Literature 1: JP 6032374 B2

SUMMARY

Technical Problem

However, the press forming method disclosed in Patent Literature 1 is a method that needs to hold down the inside of the product away from the flange using a wrinkle suppression pad. Therefore, the method has a problem that the technique cannot be applied to a shape having occurrence of wrinkles or fractures in the flange portion itself.

The present invention has been made in view of the above problem, and aims to provide a press forming tool and a press forming method applicable to a press forming part having an occurrence of wrinkles and fractures in a flange itself and capable of simultaneously suppressing the wrinkles and fractures occurring in the flange.

Solution to Problem

A press forming tool according to the present invention for forming a press forming part, the press forming part including: a top portion; a side wall portion continuous from the top portion and having a recessed portion in which a bottom edge, which is a side portion on an opposite side of the top portion in a side view, is recessed toward the top portion; and a flange portion formed outward on the bottom edge of the side wall portion, the recessed portion including a first curved portion continuous with the bottom edge being a portion having a large wall depth, an inclined side portion continuous with the first curved portion, a second curved portion continuous with the inclined side portion, and a recessed side portion having a small wall depth, arranged in order from the bottom edge being a portion having a large wall depth, the flange portion being formed such that the flange portion formed in the first curved portion becomes a shrink flange while the flange portion formed in the second curved portion becomes a stretch flange, includes: an upper die; a lower pad configured to work in cooperation with the upper die to form the top portion, the side wall portion, and the flange portion in the bottom edge being portions having a large wall depth, and the first curved portion, in the side wall portion, and form a torsional shape portion at the inclined side portion; and a lower die disposed adjacent to the lower pad and configured to work in cooperation with the upper die to form the torsional shape portion into the flange portion, and form the flange portion in the second curved portion continuous with the inclined side portion and in the recessed side portion, wherein the upper die includes: a top forming portion configured to form the top portion; a side wall forming portion configured to form the side wall portion; a bottom edge flange forming portion configured to form the flange portion on the bottom edge that is an opposite side portion of the top portion of the side wall portion; a first curved portion flange forming portion configured to form the flange portion in the first curved portion; an inclined side portion flange forming portion configured to form the flange portion in the inclined side portion; a second curved portion flange forming portion configured to form the flange portion in the second curved portion; and a recessed side portion flange forming portion configured to form the flange portion in the recessed side portion, the lower pad includes: a lower pad top forming portion; a lower pad side wall forming portion; a lower pad bottom edge flange forming portion; and a lower pad first curved portion flange forming portion, the lower die includes: a lower die inclined side portion flange forming portion configured to form the flange portion in the inclined side portion; a lower die second curved portion flange forming portion configured to form the flange portion in the second curved portion; and a lower die recessed side portion flange forming portion configured to form the flange portion in the recessed side portion, and press forming is performed such that by using the upper die and the lower pad during an initial stage of forming, the top portion, the side wall portion, and the flange portion in the bottom edge being a portion having a large wall depth and in the first curved portion, of the side wall portion, are formed, and a torsional shape portion is formed in the inclined side portion, and by using the upper die and the lower die during a late stage of forming, the torsional shape portion is formed into the flange portion, and the flange portion is formed in the second curved portion and in the recessed side portion so as to achieve formation of a target shape.

A press forming method according to the present invention for forming a press forming part by using the press forming tool according to claim 1, the press forming part including: a top portion; a side wall portion continuous from the top portion, the side wall portion having a recessed portion in which a bottom edge, which is a side portion on an opposite side of the top portion in a side view, is recessed toward the top portion; and a flange portion formed outward on the bottom edge of the side wall portion, the recessed portion including a first curved portion continuous with the bottom edge being a portion having a large wall depth, an inclined side portion continuous with the first curved portion, a second curved portion continuous with the inclined side portion, and a recessed side portion having a small wall depth, arranged in order from the bottom edge being a portion having a large wall depth, the flange portion being formed such that the flange portion formed in the first curved portion becomes a shrink flange while the flange portion formed in the second curved portion becomes a stretch flange, includes: an initial forming step of, by using the upper die and the lower pad, forming the top portion, the side wall portion, and the flange portion in the bottom edge being a portion having a large wall depth and in the first curved portion, of the side wall portion, and forming a torsional shape portion in the inclined side portion; and a late forming step of moving the lower die relatively with respect to the upper die while sandwiching a blank between the upper die and the lower pad, forming the torsional shape portion into the flange portion, and forming the flange portion in the second curved portion and in the recessed side portion so as to achieve formation of a target shape.

Advantageous Effects of Invention

According to the press forming tool and the press forming method of the present invention, formation using the upper die and the lower pad is performed in an initial stage of forming such that the top portion, the side wall portion, and the flange portion in a bottom edge being a portion having a large wall depth and in a first curved portion, of the side wall portion, are formed, and the torsional shape portion is formed in the inclined side portion, and formation using the upper die and the lower die is performed at a late stage of forming such that the torsional shape portion is formed into a flange portion, and a flange portion is formed in the second curved portion and in the recessed side portion so as to achieve formation of a target shape, making it possible to apply the technique to a press forming part in which wrinkles or fractures occur in the flange itself, and possible to simultaneously suppress wrinkles and fractures occurring in the flange.

DESCRIPTION OF EMBODIMENTS

Figure 12:
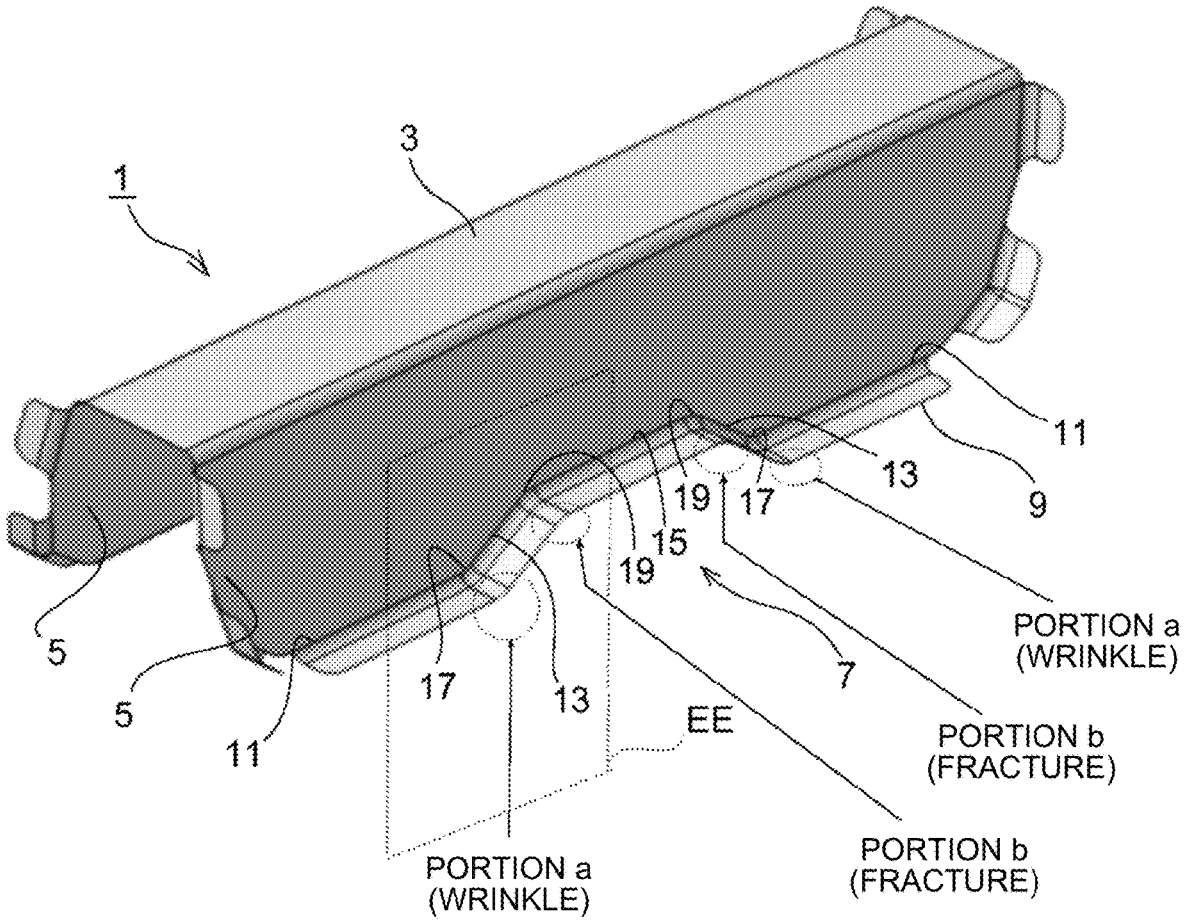
FIG. 12 is a view illustrating a target shape and a problem occurring in a forming process of the target shape according to the embodiment.

Prior to the description of the press forming tool and the press forming method according to the present embodiment, an example of a press forming part to be formed in the present invention will be described with reference to FIGS. 12 and 13. A press forming part 1 illustrated in FIG. 12 is a floor front cross member which is an automotive part. The press forming part 1 includes a top portion 3; a side wall portion 5 continuous from the top portion 3, the side wall portion 5 having a recessed portion 7 in which a bottom edge 11, which is a side portion opposite to the top portion in a side view, is recessed toward the top portion 3; and a flange portion 9 formed outward on the bottom edge 11 of the side wall portion 5.

The recessed portion 7 includes: a pair of inclined side portions 13 continuous from the bottom edge 11 being a portion having a large wall depth; and a recessed side portion 15 being a portion connecting ends of the inclined side portions 13 and having a small wall depth. There are provided: a pair of first curved portions 17 curved from the bottom edge 11 being a portion having a large wall depth to the inclined side portion 13; and a pair of second curved portions 19 curved from the inclined side portion 13 to a portion having a small wall depth. The flange portion 9 formed in the first curved portion 17 is subjected to shrink flange forming, and the flange portion 9 formed in the second curved portion 19 is subjected to stretch flange forming.

When such a press forming part 1 is formed by a conventional press forming method, wrinkles are likely to occur due to an excess metal in a portion (portion a surrounded by a round broken line in the drawing) that is subjected to shrink flange forming, while fractures due to material shortage are likely to occur in a portion (portion b surrounded by a round broken line in the drawing) that is subjected to stretch flange forming.

A mechanism of occurrence of the wrinkles and the fractures will be described with reference to FIG. 13.

Figure 13:
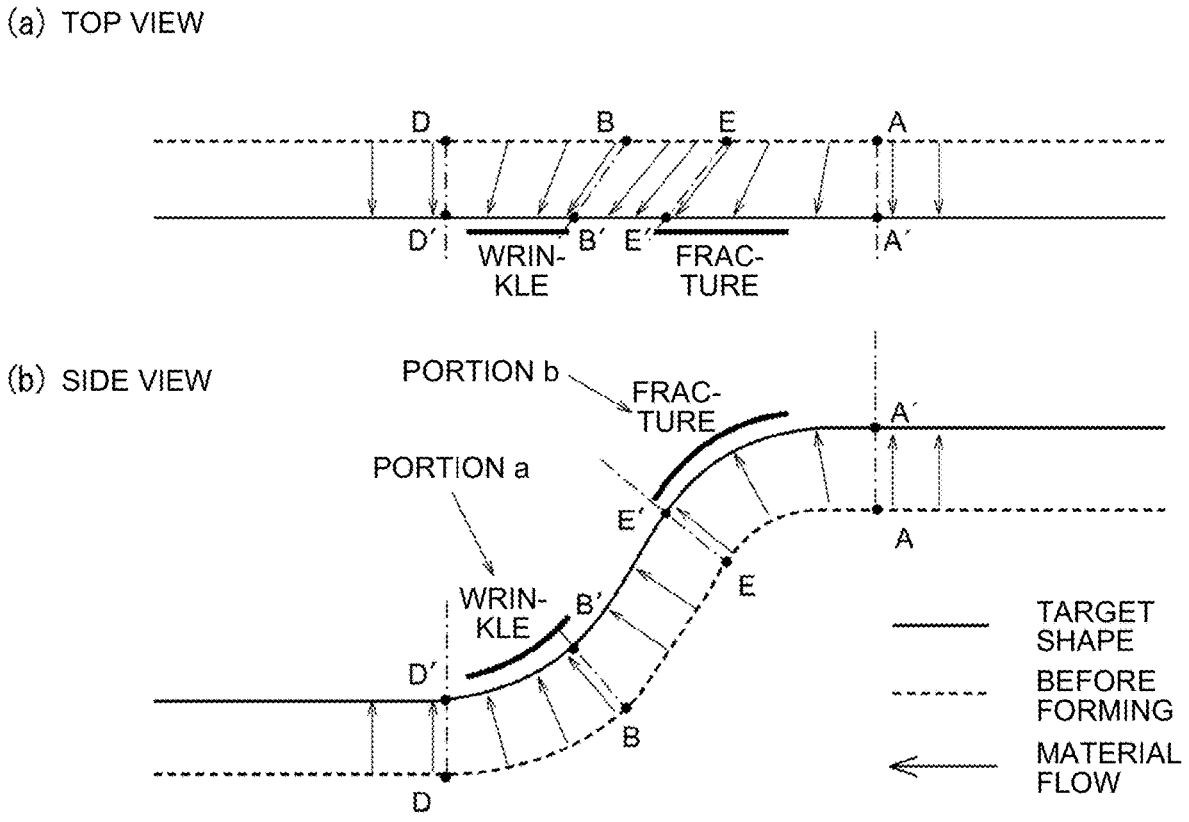
FIG. 13 is a diagram illustrating a mechanism of occurrence of wrinkles and fractures in the forming process of the target shape illustrated in FIG. 12.

FIG. 13 is a diagram illustrating a material flow in the forming process in portion EE surrounded by the broken line in FIG. 12, illustrating a top view (FIG. 13(*a*)) and a side view of (FIG. 13(*b*)) of FIG. 12. In FIG. 13, a broken line is a tip of the blank before forming, and a solid line is an edge of the flange portion 9 formed into a target shape. In addition, points D and B in the drawing correspond to R-finish (the boundary between a curve and strait line) of the first curved portion 17 in the blank before forming, and corresponding intersections of lines extending perpendicular to the edge of the target shape from points D and B in the side view and the edge of the target shape are points D' and B'. Similarly, points A and E in the drawing correspond to R-finish of the second curved portion 19 in the blank before forming, and corresponding intersections of lines extending perpendicular to the edge of the target shape from points E and A in the side view and the edge of the target shape are points A' and E'. As illustrated in the side view of FIG. 13(*b*), since the material flows substantially perpendicularly to the ridge line (line of bending), the material flows in a direction in which the material gathers in portion a, and flows in a direction in which the material leaves in portion b. Accordingly, wrinkles are likely to occur in portion a, while fractures are likely to occur in portion b.

In order to solve such a problem, the inventors have devised a press forming tool and a press forming method in which a preformed part 20, which facilitates inflow of a material from a portion where shrink flange forming occurs to a portion where stretch flange forming occurs, is interposed in the middle of forming, thereby enabling avoidance of concentration of compressive strain and tensile strain in each of the portions. Specifically, the press forming tool and the press forming method have the following configurations.

Figure 1:
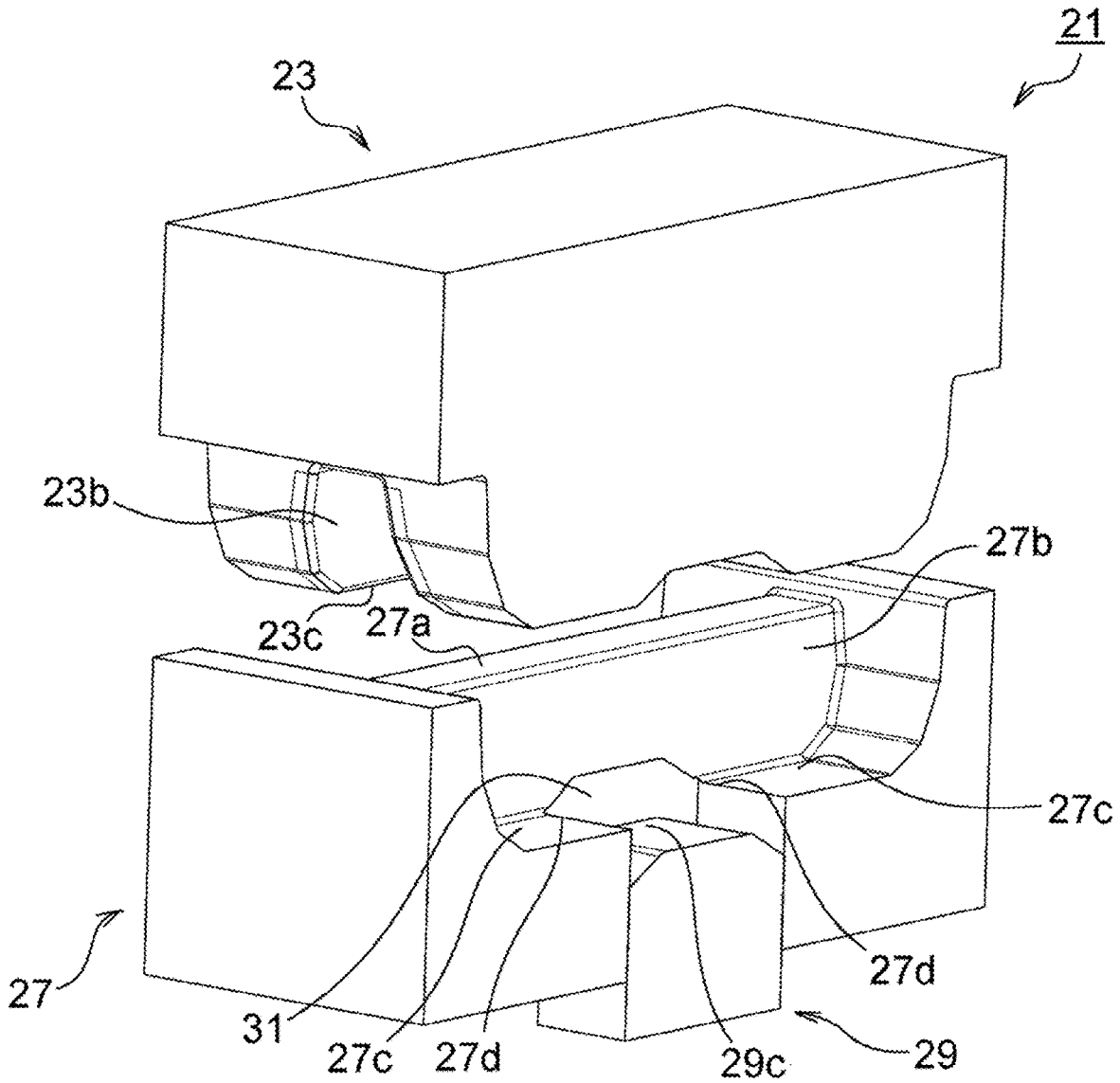
FIG. 1 is a view illustrating a press forming tool according to an embodiment of the present invention (part 1).
Figure 2:
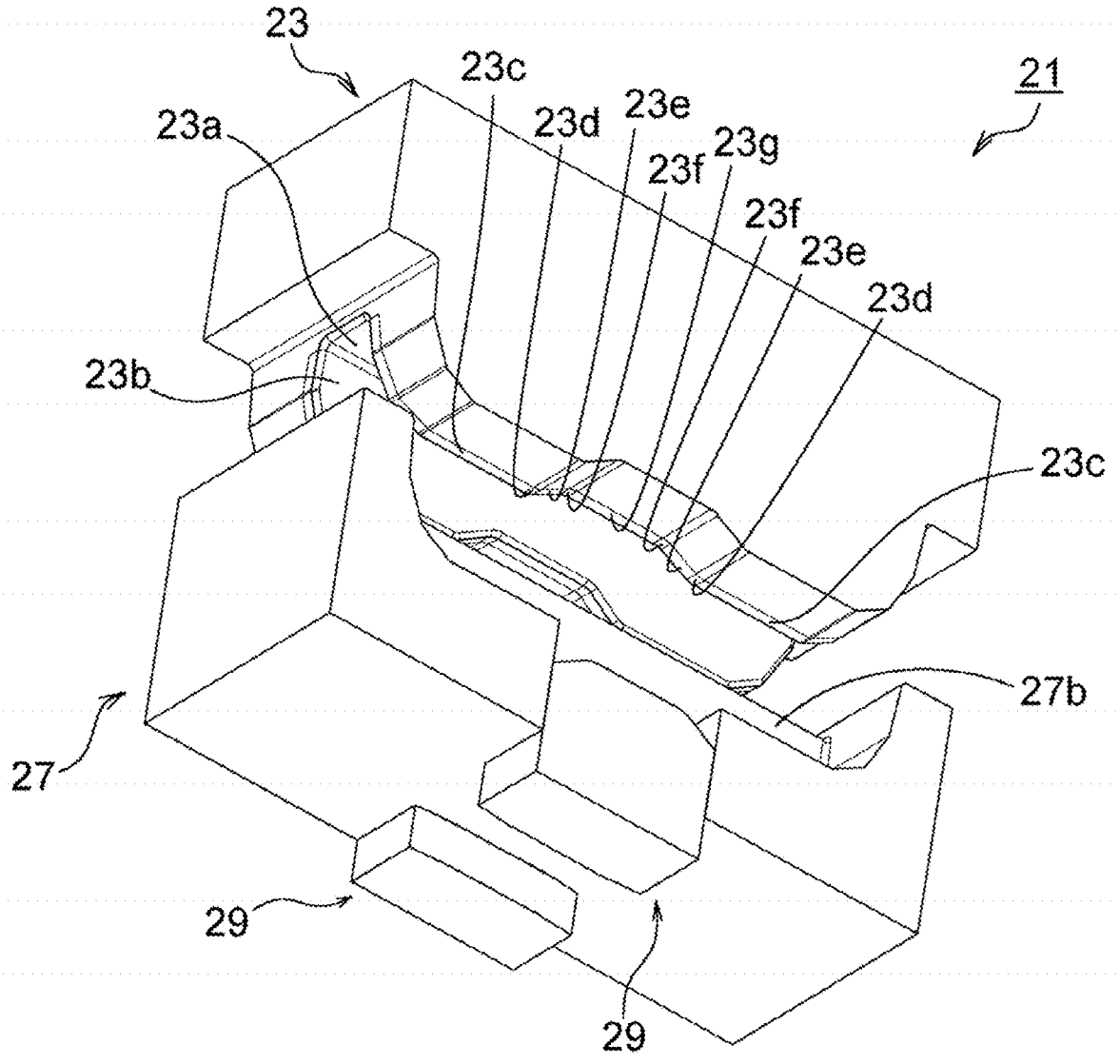
FIG. 2 is a view illustrating the press forming tool according to the embodiment of the present invention (part 2).

The press forming tool 21 according to the present embodiment is used to form the press forming part 1 as illustrated in FIG. 12, for example. The press forming part 1 illustrated in FIG. 12 includes the top portion 3; the side wall portion 5 continuous from the top portion 3, the side wall portion 5 having the recessed portion 7 in which a bottom edge 11, which is a side portion opposite to the top portion in a side view, is recessed toward the top portion 3; and the flange portion 9 formed outward on the bottom edge 11 of the side wall portion 5. In addition, the recessed portion 7 includes the first curved portion 17 continuous with the bottom edge 11 being a portion having a deep wall depth, the inclined side portion 13 continuous with the first curved portion 17, the second curved portion 19 continuous with the inclined side portion 13, and the recessed side portion 15 having a small wall depth, arranged in order from the bottom edge 11 being a portion having a deep wall depth. The flange portion 9 formed in the first curved portion 17 correspond to a shrink flange, and the flange portion 9 formed in the second curved portion 19 corresponds to a stretch flange. As illustrated in FIGS. 1 and 2, the press forming tool 21 include an upper die 23, a lower pad 27, and a lower die 29. The lower pad 27 works in cooperation with the upper die 23 and forms the top portion 3, the side wall portion 5, and the flange portion 9 on the bottom edge 11 being a portion having a large wall depth and the first curved portion 17 in the side wall portion 5, and forms a torsional shape portion 25 in the inclined side portion 13. The lower die 29 is disposed adjacent to the lower pad 27, forms the torsional shape portion 25 into the flange portion 9 in cooperation with the upper die 23, and forms the flange portion 9 in the second curved portion 19 and the recessed side portion 15 continuous with the inclined side portion 13. Note that the terms of upper and lower in the upper die and the lower die are expressions indicating their relative relationship, and thus, the positions are not necessarily limited to the upper and lower positions, but simply indicate that they are provided in a pair.

Figure 3:
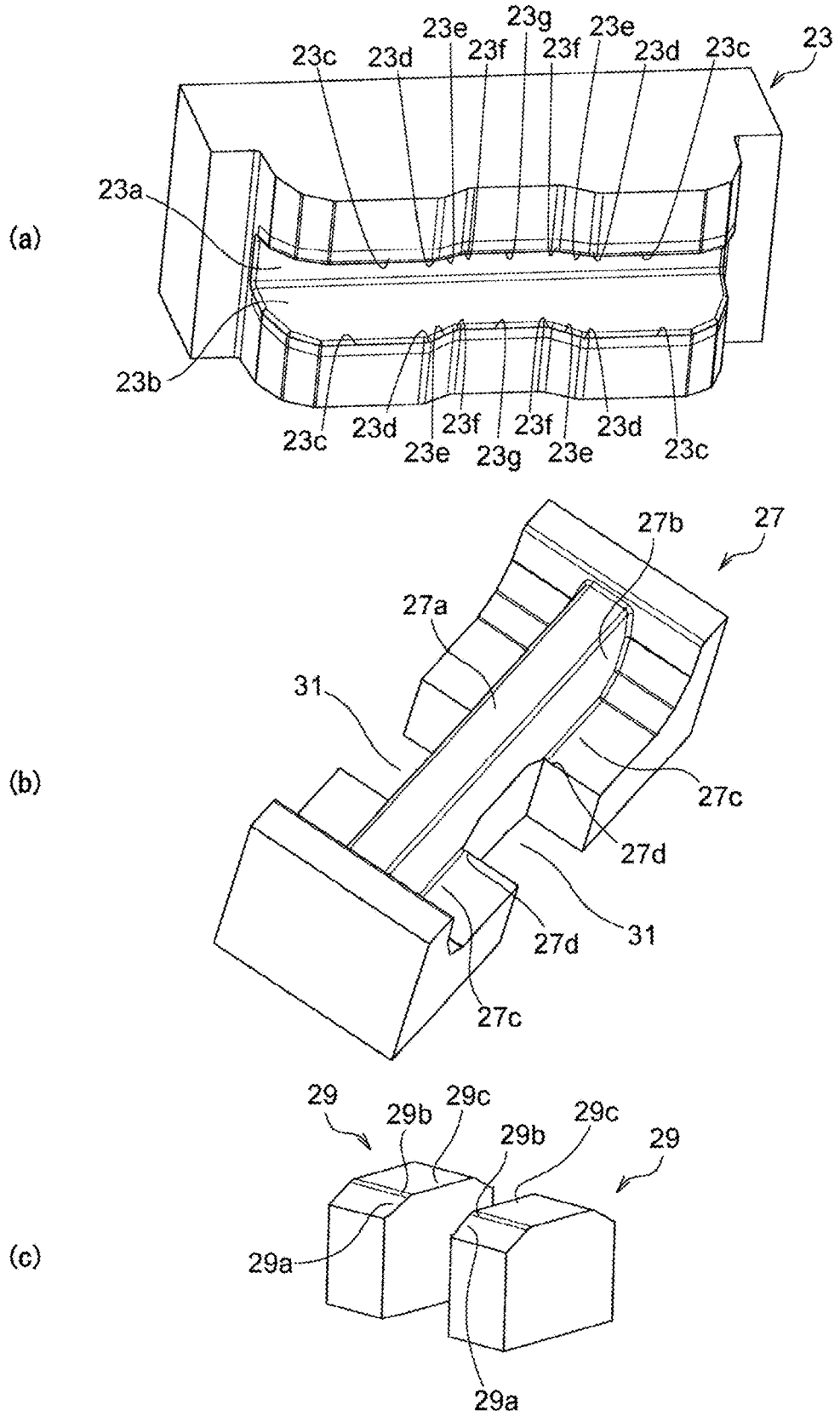
FIG. 3 is a view separately illustrating the press forming tool according to the embodiment of the present invention, in which FIG. 3(*a*) illustrates an upper die, FIG. 3(*b*) illustrates a lower pad, and FIG. 3(*c*) illustrates a lower die.

As illustrated in FIGS. 2 and 3(*a*), the upper die 23 includes a top forming portion 23*a*, a side wall forming portion 23*b*, a bottom edge flange forming portion 23*c*, a first curved portion flange forming portion 23*d*, an inclined side portion flange forming portion 23*e*, a second curved portion flange forming portion 23*f*, and a recessed side portion flange forming portion 23*g*. The top forming portion 23*a* forms the top portion 3. The side wall forming portion 23*b* forms the side wall portion 5. The bottom edge flange forming portion 23*c* forms the flange portion 9 on the bottom edge 11 of the side wall portion 5. The first curved portion flange forming portion 23*d* forms the flange portion 9 in the first curved portion 17. The inclined side portion flange forming portion 23*e* forms the flange portion 9 in the inclined side portion 13. The second curved portion flange forming portion 23*f* forms the flange portion 9 in the second curved portion 19. The recessed side portion flange forming portion 23*g* forms the flange portion 9 in the recessed side portion 15.

As illustrated in FIGS. 1 and 3(*b*), the lower pad 27 includes a lower pad top forming portion 27*a*, a lower pad side wall forming portion 27*b*, a lower pad bottom edge flange forming portion 27*c*, and a lower pad first curved portion flange forming portion 27*d*. The lower pad top forming portion 27*a* has a shape corresponding to the top forming portion 23*a* of the upper die 23. The lower pad side wall forming portion 27*b* has a shape corresponding to the side wall forming portion 23*b* of the upper die 23. The lower pad bottom edge flange forming portion 27*c* has a shape corresponding to the bottom edge flange forming portion 23*c* of the upper die 23. The lower pad first curved portion flange forming portion 27*d* has a shape corresponding to the first curved portion flange forming portion 23*d* of the upper die 23. In the lower pad 27, a portion between the lower pad first curved portion flange forming portions 27*d* adjacent in an axial direction, that is, a portion of the lower pad 27 facing the second curved portion flange forming portion 23*f* and the recessed side portion flange forming portion 23*g* of the upper die 23 is a hollow portion 31, and the lower die 29 is disposed in the hollow portion 31.

As illustrated in FIGS. 1 and 3(*c*), the lower die 29 is movable independently of the lower pad 27. The lower die 29 includes: a lower die inclined side portion flange forming portion 29*a* that forms the flange portion 9 in the inclined side portion 13; a lower die second curved portion flange forming portion 29*b* that forms the flange portion 9 in the second curved portion 19; and a lower die recessed side portion flange forming portion 29*c* that forms the flange portion 9 in the recessed side portion.

Figure 4:
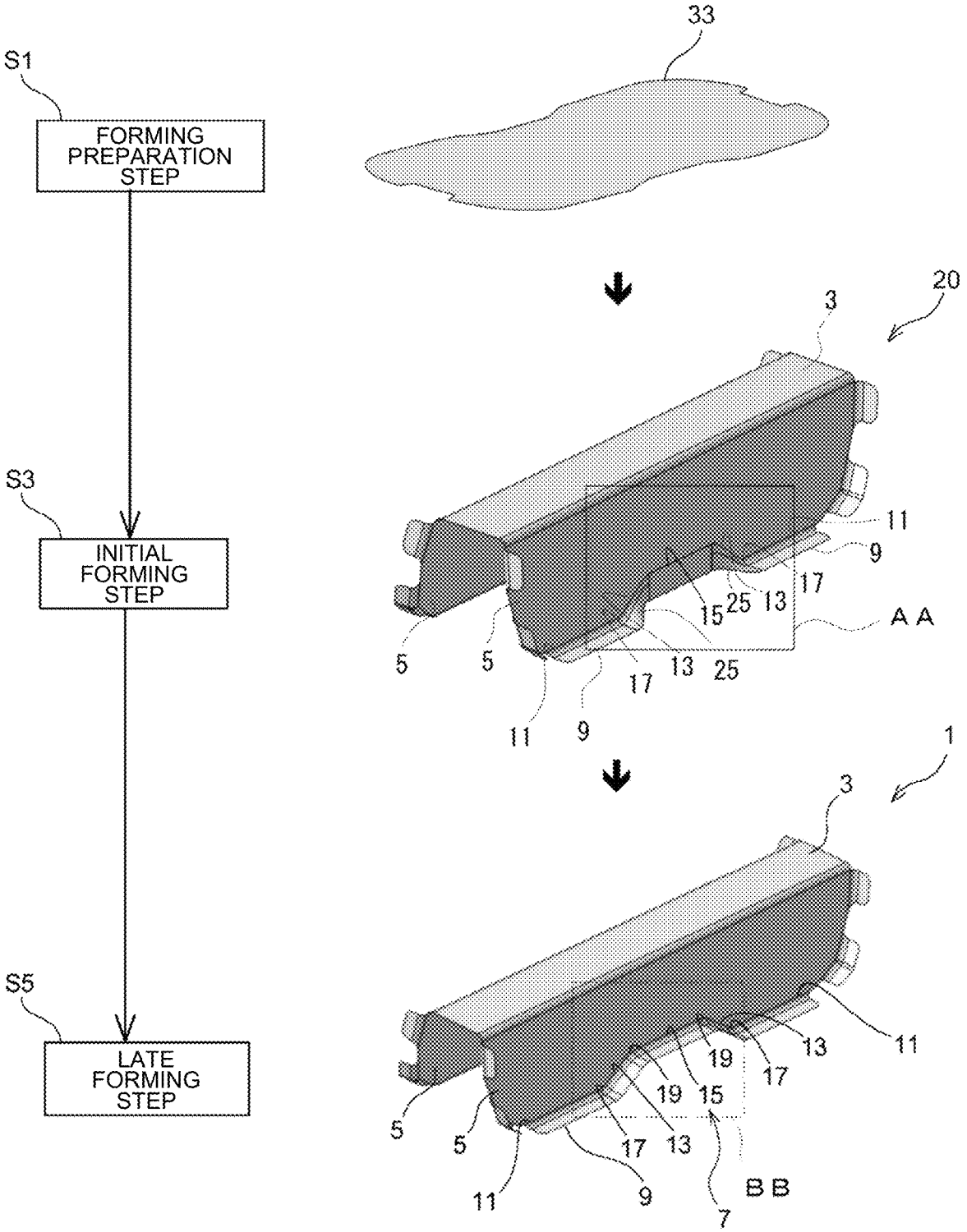
FIG. 4 is a view illustrating a press forming method according to the embodiment of the present invention.
Figure 5:
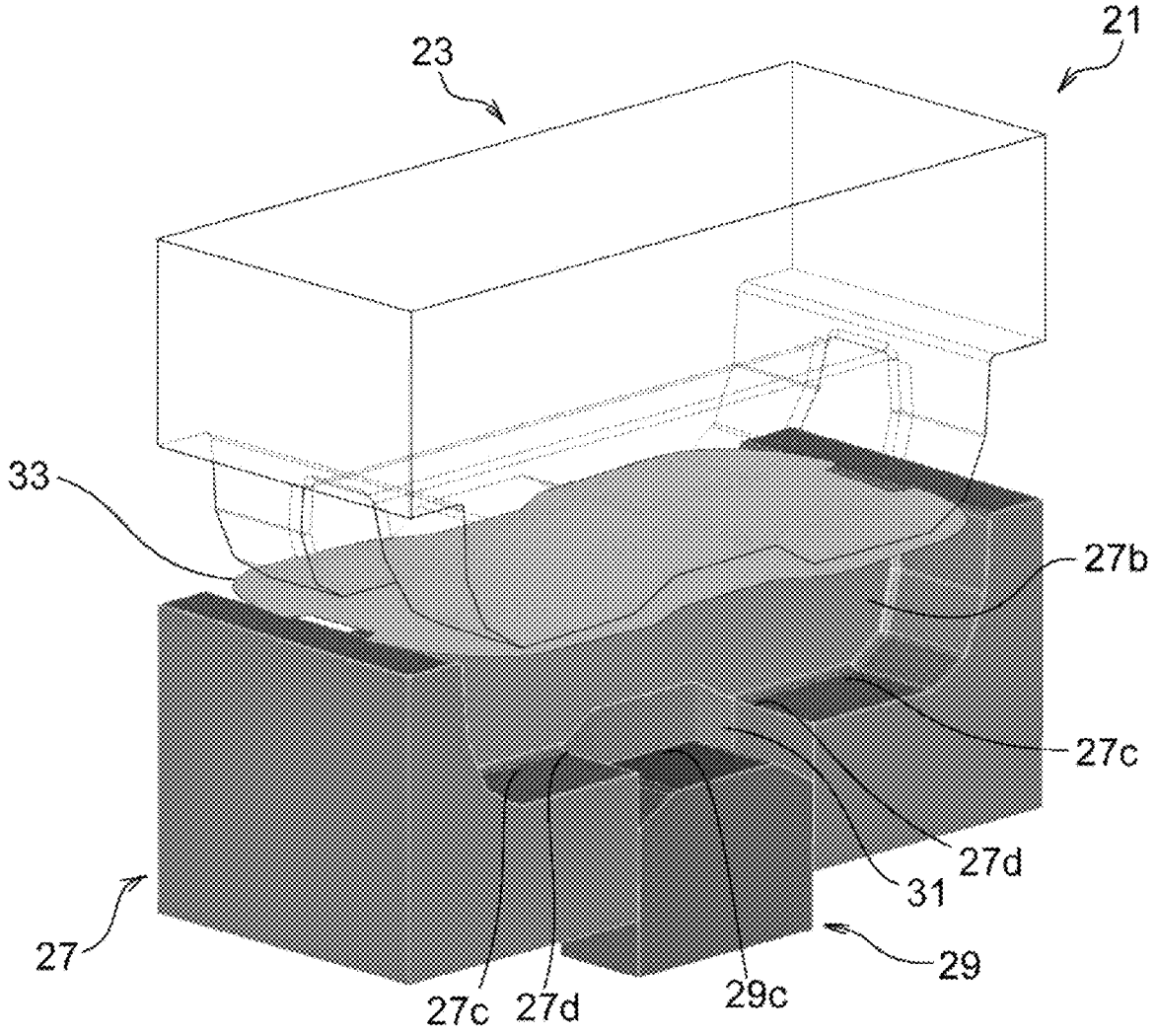
FIG. 5 is a view illustrating states of tools in a forming preparation step of the press forming method according to the embodiment of the present invention.
Figure 6:
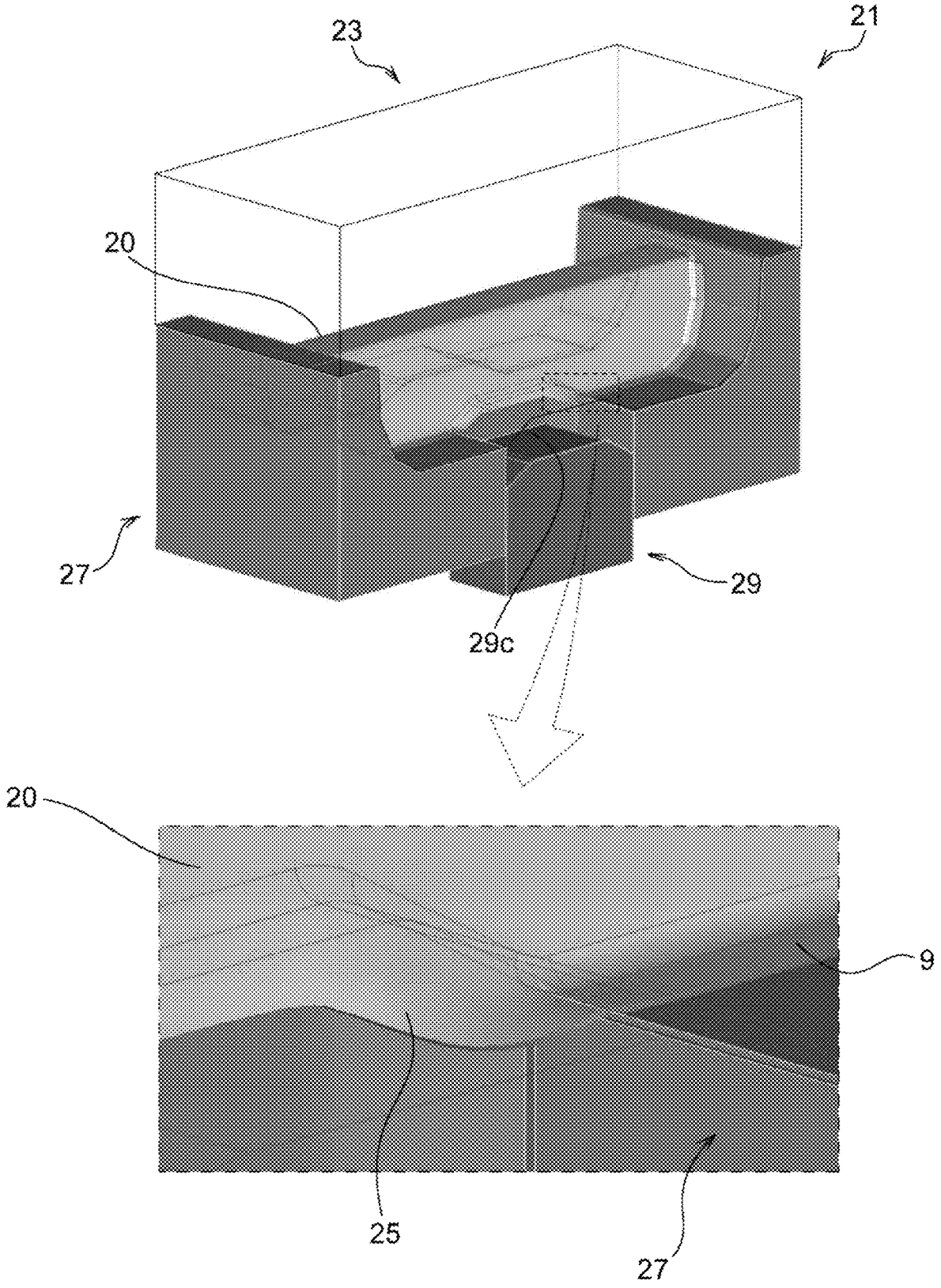
FIG. 6 is a view illustrating states of tools in an initial forming step of the press forming method according to the embodiment of the present invention.
Figure 8:
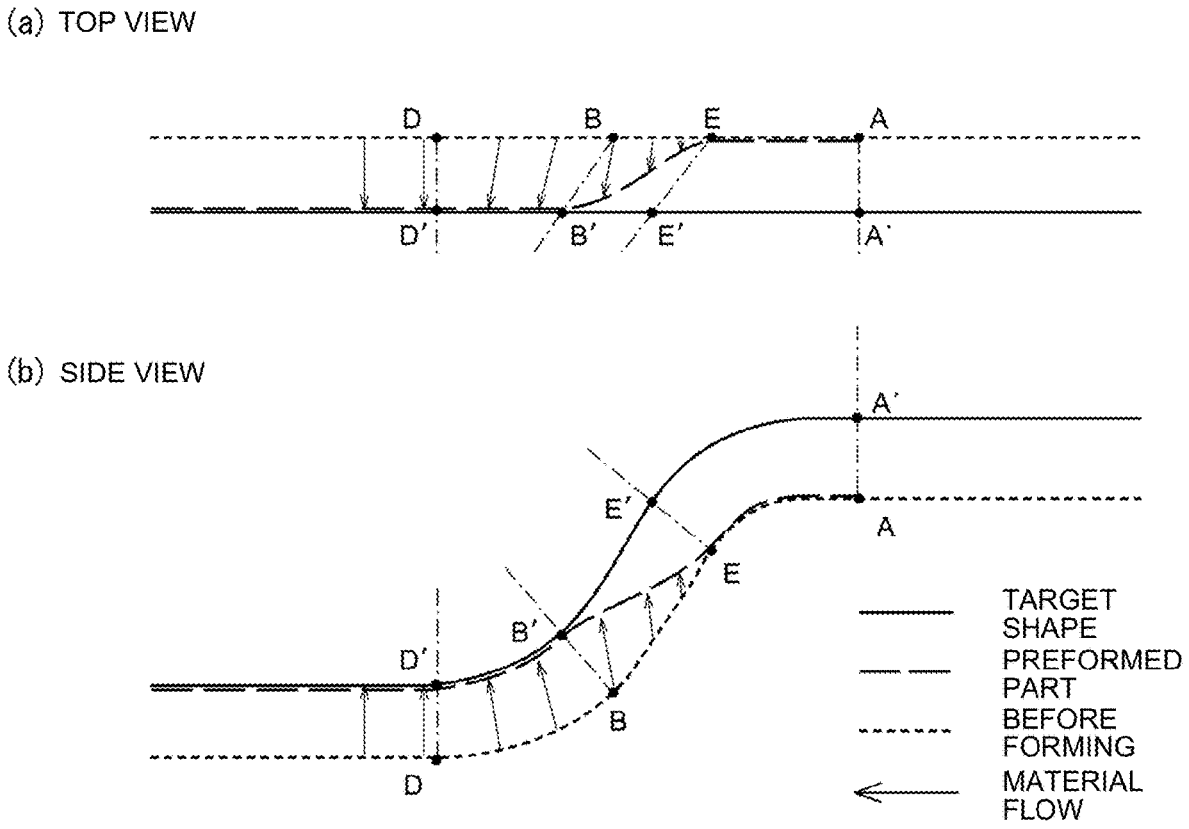
FIG. 8 is a view illustrating a mechanism of suppressing occurrence of wrinkles in the initial forming step.
Figure 9:
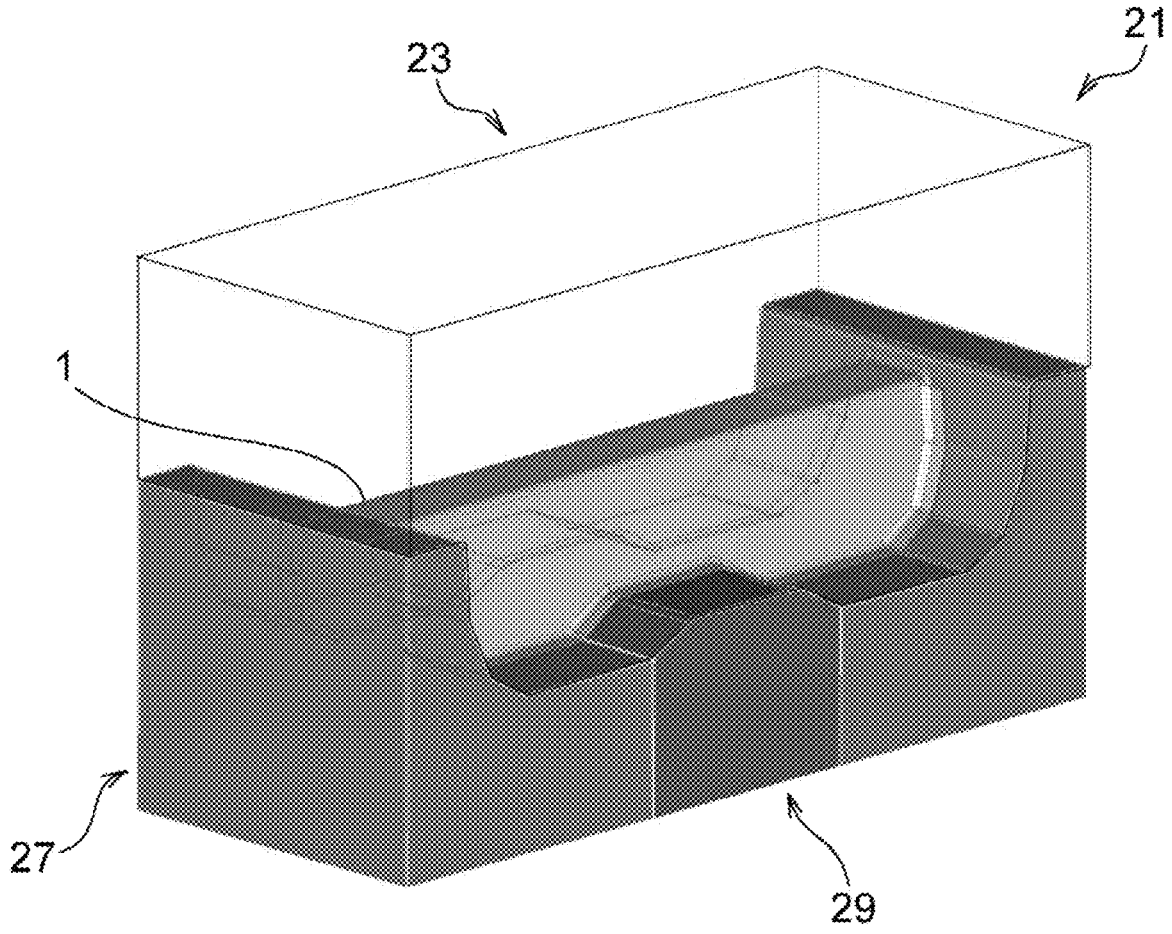
FIG. 9 is a view illustrating states of tools in a late forming step of the press forming method according to the embodiment of the present invention.

Next, a method of forming the floor front cross member illustrated in FIG. 12 as an example using the press forming tool 21 of the present embodiment as described above will be described. As illustrated in FIG. 4, the press forming method of the present embodiment includes a forming preparation step S1 of setting a blank 33 in the press forming tool 21, an initial forming step S3, and a late forming step S5. Hereinafter, each step will be described in detail with reference to FIGS. 4 to 11. In FIGS. 5, 6, and 9 illustrating the movement of the tools, the upper die 23 is drawn as a transparent perspective view to demonstrate the forming state of the blank 33.

<Forming Preparation Step>

In forming preparation step S1, as illustrated in FIG. 5, the blank 33 made of a metal sheet is placed on a lower pad 27. At this time, the lower die 29 is retracted downward, with its upper surface, that is, the lower die recessed side portion flange forming portion 29*c* being positioned below the lower pad bottom edge flange forming portion 27*c* of the lower pad 27.

<Initial Forming Step>

In the initial forming step S3, as illustrated in FIG. 6, the upper die 23 is moved toward the lower pad 27 up to a bottom dead center of formation. With this process, the upper die 23 and the lower pad 27 form the top portion 3, the side wall portion 5, and the flange portion 9 on the bottom edge 11 being a portion having a large wall depth and the first curved portion 17 in the side wall portion 5, while forming the torsional shape portion 25 (FIG. 7) on the inclined side portion 13. In a state where the upper die 23 illustrated in FIG. 6 has moved to the bottom dead center of formation, the lower die 29 sandwiching the blank 33 does not exist at the portions of the upper die 23 (FIG. 3) corresponding to the inclined side portion flange forming portion 23*e*, the second curved portion flange forming portion 23*f*, and the recessed side portion flange forming portion 23*g*. Accordingly, the flange portion 9 is not formed in the recessed side portion 15 while the flange portion 9 is formed in the first curved portion 17 on the lower end side of the inclined side portion 13 illustrated in FIG. 7. This results in formation of the torsional shape portion 25.

Figure 7:
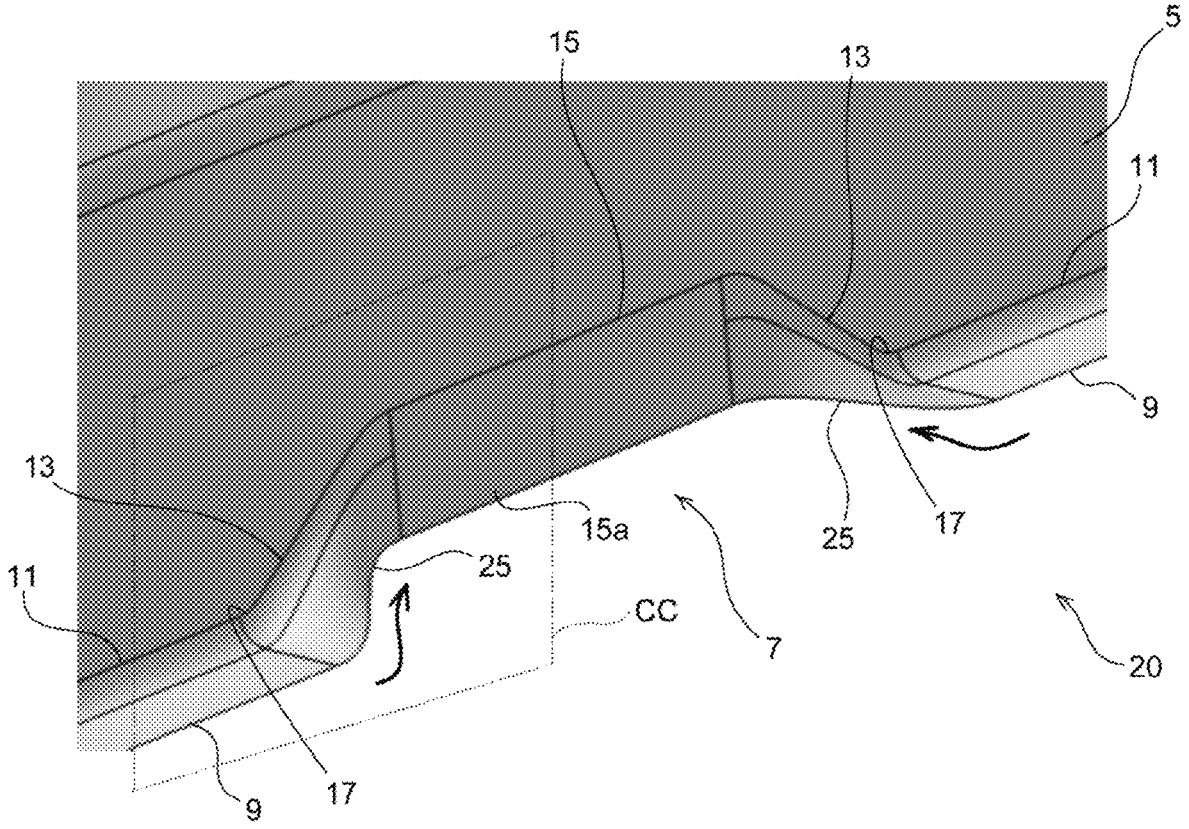
FIG. 7 is an enlarged view of portion AA of a formed part in the initial forming step in FIG. 4.

As illustrated in FIG. 7, the torsional shape portion 25 has one end side connected to the flange portion 9 formed in the first curved portion 17 while having the other end side connected to a blank end 15*a* before forming, resulting in forming the torsional shape. At the time of forming the torsional shape portion 25, as indicated by an arrow in FIG. 7, the metal inflow occurs from the first curved portion 17 side to the inclined side portion 13, alleviating the excess metal in the shrink flange forming, making it possible to suppress occurrence of wrinkles.

A mechanism of occurrence of the material flow will be described with reference to FIG. 8. FIG. 8 is a view illustrating the material flow in the forming process in portion CC surrounded by the broken line in FIG. 7, illustrating a top view and a side view of the preformed part 20 in FIG. 7. In FIG. 8, a fine broken line is an edge of the blank 33 before forming, a coarse broken line is an edge of the preformed part 20, and a solid line is an edge of the flange portion 9 in the target shape. Points A to E and points A' to E' in the drawing are the same as those illustrated in FIG. 13. That is, point A in the drawing is an R-finish of the second curved portion 19 in the blank 33, and is a tip position of the torsional shape portion 25. Point B is a point corresponding to one R-finish (FIG. 13) of the blank portion having occurrence of shrink flange forming in a conventional case, and point B' is an intersection of a line extending perpendicularly to the edge of the torsional shape portion 25 from point B in the side view and the edge of the torsional shape portion 25. Point D is an R-finish of the first curved portion 17 of the blank 33, and point D' is an intersection of a line perpendicular to the edge of the target shape from point D in the side view and the edge of the target shape.

Due to the shrink flange forming, the distance from point B' to point D' is shorter than the distance from point B to point D (B'D'<BD), and wrinkles are likely to occur in the first curved portion 17 due to the excess metal. On the other hand, since the distance from point A to point B' is longer than the distance from point A to point B (AB'>AB) in a three-dimensional view, the material is pulled toward point A and flows while deviating from "substantially perpendicular to the ridge line" illustrated in portion a of FIG. 13. Therefore, the material flow indicated by the arrow in FIG. 8 is generated, the material flow being closer to point A as compared with the conventional material flow indicated by the arrow in the wrinkle occurrence region in FIG. 13. This material flow alleviates the excess metal in shrink flange forming during the initial stage of forming, leading to prevention of occurrence of wrinkles.

Figure 14:
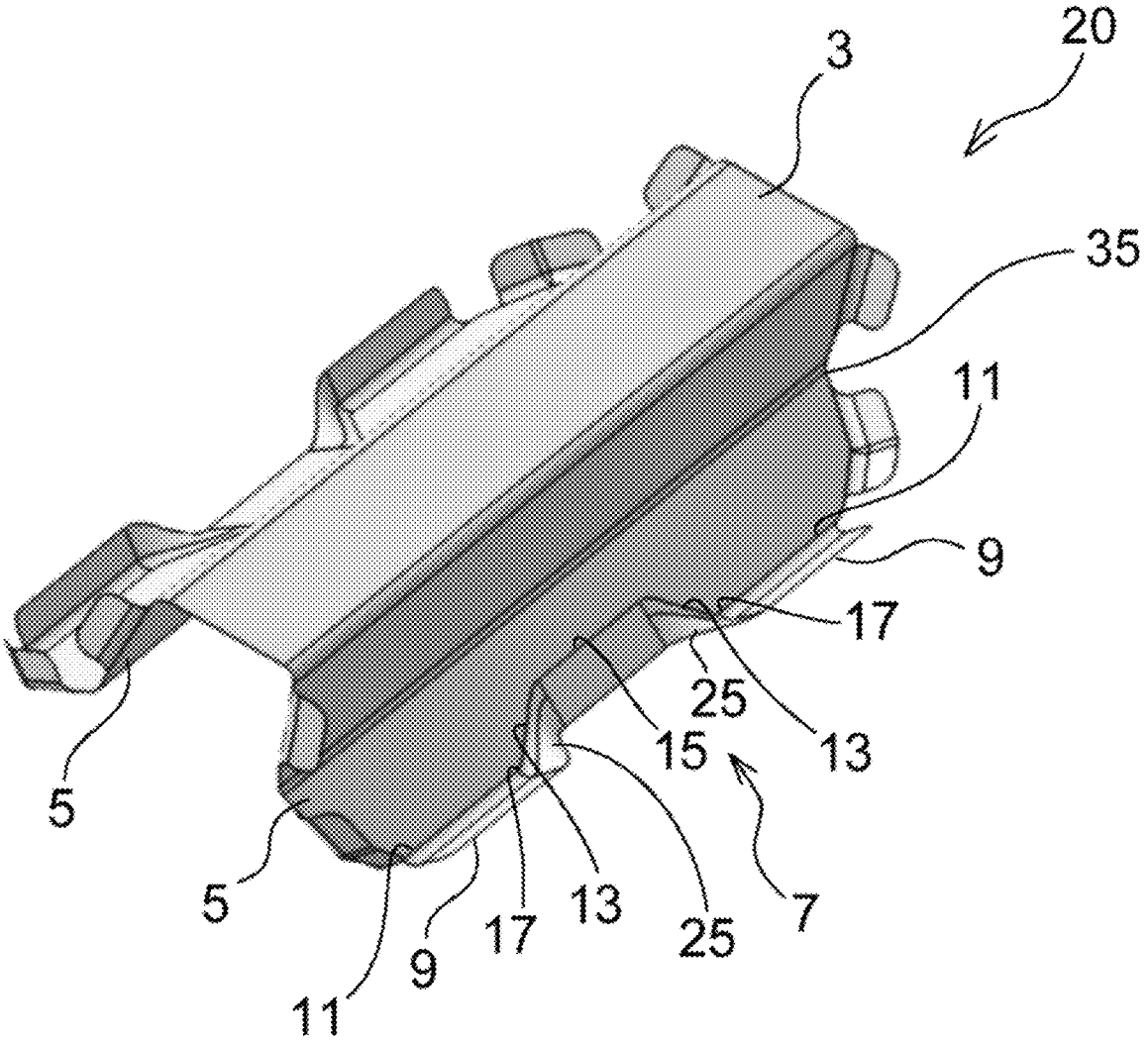
FIG. 14 is a view illustrating another example of the preformed part in FIG. 4.

In the initial forming step S3, as illustrated in FIG. 14, a bending portion 35 may be formed at an intermediate portion of the side wall portion 5 in the height direction having an angle at which the lower side of the side wall portion 5 opens outward. The reason for this is as follows. In application of the present invention, forming the flange portion 9 while the side wall portion 5 is kept vertical would increase a bending angle between the side wall portion 5 and the flange portion 9 due to springback, leading to high probability of occurrence of curl in the side wall portion 5. By forming the bending portion 35, the flange portion 9 can be formed with a tool having a downward V-shaped tip. This makes it possible to have a sharp bending angle between the side wall portion 5 and the flange portion 9, and possible to decrease the height of the side wall portion 5 adjacent to the flange portion 9, leading to suppression of the curl. As a result, it is easy to form only a part of the flange portion 9, that is, a shrink flange forming portion.

<Late Forming Step>

In the late forming step S5, as illustrated in FIG. 9, the lower die 29 is moved toward the upper die 23 in a state where the blank 33 is sandwiched between the upper die 23 and the lower pad 27 so as to form the torsional shape portion 25 into the flange portion 9, and the flange portion 9 is formed in the second curved portion 19 and the recessed side portion 15 to obtain a target shape. In the forming process of the late forming step S5, as indicated by the arrow in FIG. 10, by returning the torsion from the torsional shape portion 25 that has absorbed the excess metal in FIG. 7, the excess metal causes the metal inflow into the stretch flange forming portion, alleviating the material shortage of the stretch flange forming portion, leading to suppression of occurrence of fracture.

Figure 10:
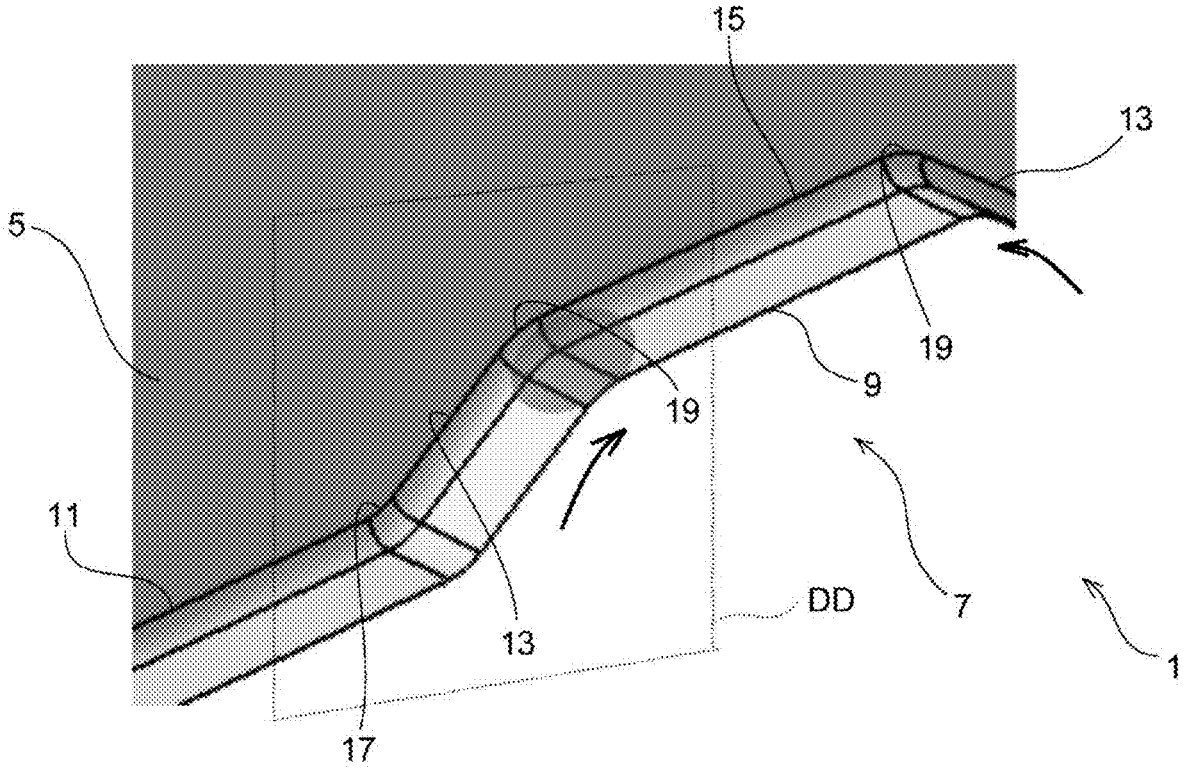
FIG. 10 is an enlarged view of portion BB in a target shape in the late forming step of FIG. 4.
Figure 11:
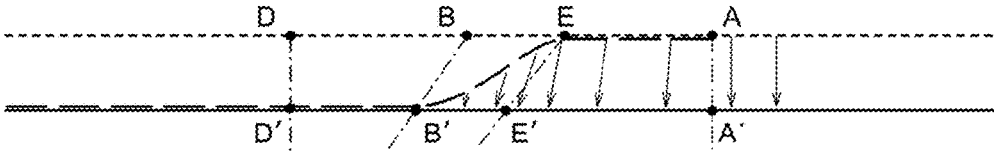
FIG. 11 is a view illustrating a mechanism of suppressing occurrence of fractures in the late forming step.
Figure 11:
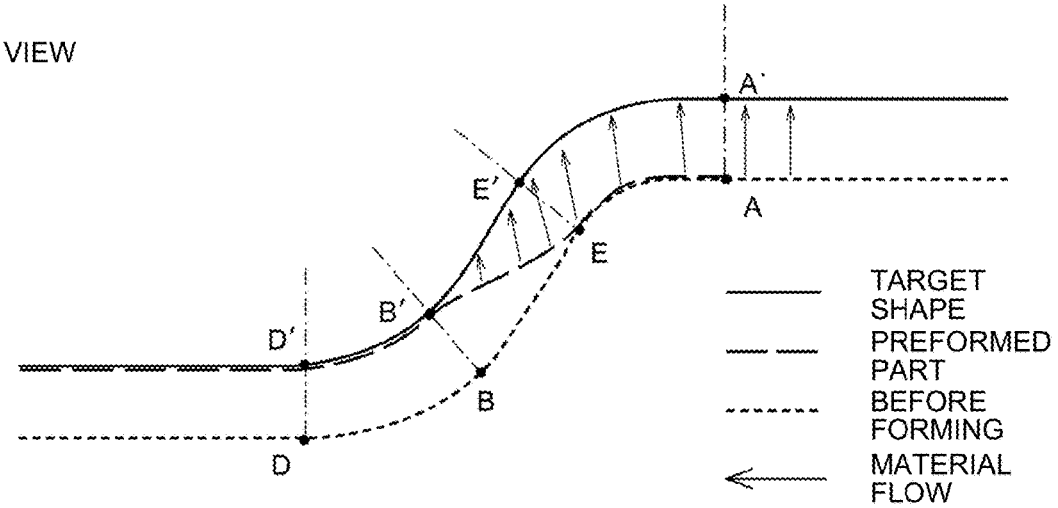

A mechanism of occurrence of the material flow will be described with reference to FIG. 11. FIG. 11 is a view illustrating the material flow in the forming process of the DD portion surrounded by the broken line in FIG. 10, illustrating a top view and a side view of FIG. 10. In FIG. 11, a fine broken line is an edge of the blank before forming, a coarse broken line is an edge of the torsional shape portion 25, and a solid line is an edge of the flange portion 9 in the target shape. In addition, points A to E and points A' to E' in the drawing are the same as those illustrated in FIG. 13.

Due to the stretch flange forming, the distance from point A' to point E' is longer than the distance from point A to point E (A'E'>AE), and the material shortage due to the forming of the flange portion 9 is likely to cause an occurrence of fractures in the second curved portion 19. On the other hand, since the distance from point D' to point E' is shorter than the distance from point D' to point E (D'E'<D'E) in a three-dimensional view, the material is pushed toward the A' side and flows while deviating from "substantially perpendicular to the ridge line" illustrated in portion b in FIG. 13. Therefore, the material flow indicated by the arrow in FIG. 11 is generated, the material flow being closer to point A' as compared with the conventional material flow indicated by the arrow in the fracture occurrence region in FIG. 13. This material flow alleviates the material shortage in the stretch flange forming during the late forming step S5, leading to prevention of occurrence of fractures.

As described above, according to the press forming tool 21 of the present embodiment, by using the upper die 23 and the lower pad 27, the flange portion 9 is formed on the bottom edge 11 being a portion having a large wall depth and the first curved portion 17 in the side wall portion 5 while the torsional shape portion 25 is formed on the inclined side portion 13. Next, during the late stage of forming, by using the upper die 23 and the lower die 29, the torsional shape portion 25 is formed into the flange portion 9 while the flange portion 9 is formed in the second curved portion 19 and the recessed side portion 15, leading to the formation of the target shape. With this configuration, the torsional shape portion 25 that promotes the material flow to the portion side where the stretch flange forming occurs is formed by first forming only the portion of occurrence of the shrink flange forming during the initial stage of forming. By forming, during the late stage of forming, the portion that becomes the stretch flange forming, it is possible to form the target shape while suppressing the material shortage due to the stretch flange forming by using the material flow from the torsional shape portion 25.

In this manner, the strain at a dangerous portion where the shrink flange wrinkle occurs and the strain at the dangerous portion where the stretch flange fracture occurs are dispersed. With this configuration, occurrence of wrinkles due to shrink flange forming is suppressed in the initial forming step S3, and occurrence of fractures due to stretch flange forming is suppressed in the late forming step S5, leading to achievement of suppression of occurrence of wrinkles and fractures throughout all steps.

EXAMPLE

In order to confirm the effect of the present invention, press forming was performed using a floor front cross member as illustrated in FIG. 12 as an example of a target shape. The material was a steel sheet having a tensile strength of 1180 MPa-class and a thickness of 1.4 mm. First, as Comparative Example, a target shape was formed in one step without forming the torsional shape portion 25, and press forming was performed by a method of crash forming by using pad, in which the top portion was held with a pad. Next, as Example of the present invention, press forming including the initial forming step S3 and the late forming step S5 was performed using the press forming tool 21 described in the embodiment. In the initial forming step S3, the flange portion 9 is formed on the bottom edge 11 being a portion having a large wall depth and the first curved portion 17 in the side wall portion 5, and the torsional shape portion 25 is formed on the inclined side portion 13. In the late forming step S5, the torsional shape portion 25 is formed into the flange portion 9, while the flange portion 9 is formed in the second curved portion 19 and the recessed side portion 15 so as to achieve formation of a target shape. In addition, every forming step uses a method of crash forming by using pad, in which the top portion was held with a pad.

In the case of Comparative Example, wrinkles occurred in portion a and fractures occurred in portion b illustrated in FIG. 12, and the target shape was not successfully obtained. In contrast, in Example of the present invention, the press forming part 1 of high quality was successfully obtained with no fracture or wrinkles in the flange portion 9. As described above, the present invention is proven to be effective for suppressing stretch flange fracture and shrink flange wrinkles in formation of a press forming part having a flange portion and a greatly changing side wall depth.

INDUSTRIAL APPLICABILITY

According to the present invention, it is possible to provide a press forming tool and a press forming method applicable to a press forming part having an occurrence of wrinkles and fractures in a flange itself and capable of simultaneously suppressing the wrinkles and fractures occurring in the flange.

REFERENCE SINGS LIST

1 PRESS FORMING PART
3 TOP PORTION
5 SIDE WALL PORTION
7 RECESSED PORTION
9 FLANGE PORTION
11 BOTTOM EDGE OF DEEP PORTION
13 INCLINED SIDE PORTION
15 RECESSED SIDE PORTION
15*a* BLANK END
17 FIRST CURVED PORTION
19 SECOND CURVED PORTION
20 PREFORMED PART
21 PRESS FORMING TOOL
23 UPPER DIE
23*a* TOP FORMING PORTION
23*b* SIDE WALL FORMING PORTION
23*c* BOTTOM EDGE FLANGE FORMING PORTION
23*d* FIRST CURVED PORTION FLANGE FORMING PORTION
23*e* INCLINED SIDE PORTION FLANGE FORMING PORTION
23*f* SECOND CURVED PORTION FLANGE FORMING PORTION
23*g* RECESSED SIDE PORTION FLANGE FORMING PORTION
25 TORSIONAL SHAPE PORTION
27 LOWER PAD
27*a* LOWER PAD TOP FORMING PORTION
27*b* LOWER PAD SIDE WALL FORMING PORTION
27*c* LOWER PAD BOTTOM EDGE FLANGE FORMING PORTION
27*d* LOWER PAD FIRST CURVED PORTION FLANGE FORMING PORTION
29 LOWER DIE
29*a* LOWER DIE INCLINED SIDE PORTION FLANGE FORMING PORTION
29*b* LOWER DIE SECOND CURVED PORTION FLANGE FORMING PORTION
29*c* LOWER DIE RECESSED SIDE PORTION FLANGE FORMING PORTION
31 HOLLOW PORTION
33 BLANK
35 BENDING PORTION

The invention claimed is:

1. A press forming tool for forming a press forming part, the press forming part including: a top portion; a side wall portion continuous from the top portion and having a recessed portion in which a bottom edge, which is a side portion on an opposite side of the top portion in a side view, is recessed toward the top portion; and a flange portion formed outward on the bottom edge of the side wall portion, the recessed portion including a first curved portion continuous with the bottom edge being a portion having a large wall depth, an inclined side portion continuous with the first curved portion, a second curved portion continuous with the inclined side portion, and a recessed side portion having a small wall depth, arranged in order from the bottom edge being the portion having the large wall depth, the flange portion being formed such that the flange portion formed in the first curved portion becomes a shrink flange while the flange portion formed in the second curved portion becomes a stretch flange, the press forming tool comprising:

an upper die;

a lower pad configured to work in cooperation with the upper die to form the top portion, the side wall portion, and the flange portion in the bottom edge being portions having a large wall depth, and the first curved portion, in the side wall portion, and form a torsional shape portion at the inclined side portion; and a lower die disposed adjacent to the lower pad and configured to work in cooperation with the upper die to form the torsional shape portion into the flange portion, and form the flange portion in the second curved portion continuous with the inclined side portion and in the recessed side portion, wherein the upper die includes:

a top forming portion configured to form the top portion;

a side wall forming portion configured to form the side wall portion;

a bottom edge flange forming portion configured to form the flange portion on the bottom edge that is an opposite side portion of the top portion of the side wall portion;

a first curved portion flange forming portion configured to form the flange portion in the first curved portion;

an inclined side portion flange forming portion configured to form the flange portion in the inclined side portion;

a second curved portion flange forming portion configured to form the flange portion in the second curved portion; and a recessed side portion flange forming portion configured to form the flange portion in the recessed side portion, the lower pad includes:

a lower pad top forming portion;

a lower pad side wall forming portion;

a lower pad bottom edge flange forming portion; and a lower pad first curved portion flange forming portion, the lower die includes:

a lower die inclined side portion flange forming portion configured to form the flange portion in the inclined side portion;

a lower die second curved portion flange forming portion configured to form the flange portion in the second curved portion; and a lower die recessed side portion flange forming portion configured to form the flange portion in the recessed side portion, and press forming is performed such that by using the upper die and the lower pad during an initial stage of forming, the flange portion is formed in the top portion, the side wall portion, and the flange portion in the bottom edge being the portion having the large wall depth and in the first curved portion, of the side wall portion, are formed, and the torsional shape portion is formed in the inclined side portion, and by using the upper die and the lower die during a late stage of forming, the torsional shape portion is formed into the flange portion, and the flange portion is formed in the second curved portion and in the recessed side portion so as to achieve formation of a target shape.

2. A press forming method for forming the press forming part by using the press forming tool according to claim 1, the press forming method comprising:

an initial forming step of, by using the upper die and the lower pad, forming the top portion, the side wall portion, and the flange portion in the bottom edge being the portion having the large wall depth and in the first curved portion, of the side wall portion, and forming the torsional shape portion in the inclined side portion; and a late forming step of, in the late stage of forming, moving the lower die relatively with respect to the upper die while sandwiching a blank between the upper die and the lower pad, forming the torsional shape portion into the flange portion, and forming the flange portion in the second curved portion and in the recessed side portion so as to achieve formation of a target shape.

* * * * *